United States Patent [19]

Inouye

[11] 4,016,798

[45] Apr. 12, 1977

[54] GUN TO RUDDER INTERCONNECT SYSTEM

[75] Inventor: Sus Inouye, Los Angeles, Calif.

[73] Assignee: Northrop Corporation, Los Angeles, Calif.

[22] Filed: Aug. 25, 1975

[21] Appl. No.: 607,384

[52] U.S. Cl. ..... 89/37.5 R; 244/182; 318/586

[51] Int. Cl.[2] ..... B64D 7/04

[58] Field of Search ..... 244/182, 184, 179, 177; 89/37.5 R; 318/586

[56] References Cited

UNITED STATES PATENTS

| | | | |
|---|---|---|---|
| 2,438,905 | 4/1948 | Donicht et al. | 89/37.5 R |
| 2,855,557 | 10/1958 | Gallagher | 318/586 X |
| 2,953,329 | 9/1960 | Ascel | 244/179 X |
| 3,698,669 | 10/1972 | Miller | 244/182 X |

*Primary Examiner*—David H. Brown
*Attorney, Agent, or Firm*—William W. Rundle; Willard M. Graham

[57] ABSTRACT

An interconnect system between an off-center-line gun of an aircraft and the aircraft rudder control. When the off-center gun is fired, the trigger actuation creates a signal modified by dynamic compressible pressure $Q_c$ to cause the interconnect system to automatically deflect the rudder an amount to cancel the yaw moment produced by the gun firing. Circuitry is also disclosed to additionally compensate for any yaw moment which may arise from an extendable gun gas deflector door. The full specification must be consulted for an understanding of the invention.

10 Claims, 5 Drawing Figures

GUN TO RUDDER INTERCONNECT SYSTEM

BACKGROUND OF THE INVENTION

The invention herein described was made in the course of Contract No. F33657-74-C-0041 with the United States Air Force.

The present invention relates to aircraft, and more particularly, to airplanes having a gun, usually forward-firing, mounted at an off-center location relative to the airplane longitudinal axis, thus causing an undesired yawing motion during gun firing. Similarly, if a single such gun is mounted appreciably above or below the airplane center of gravity, an undesired pitching motion could be caused. This invention comprises means for cancelling the aforesaid yawing and/or pitching tendency.

In modern-day sophisticated aircraft carrying weapons, for example, it is common to have a plurality of fixed, forward-firing guns or cannons. These are usually placed symmetrically to the left and right of the airplane center-line, and may be in the wing or fuselage or both. In certain configurations, however, one or more guns on one side of the airplanes are intentionally omitted in favor of other equipment, such as a camera, electronic and/or navigation systems, or other gear. Placing a single gun to one side of the airplane center instead of on the center line would not be unusual, since a more efficient structure results, and gun maintenance can be improved also.

Since the yawing during gun firing can obviously move the gun off of its target tracking path, it is an object of the present invention to provide a means and methods of compensating for the yawing motion during gun firing.

Another object of this invention is to provide such yaw compensating means which is variable in action depending upon dynamic air pressure at the time of gun firing, thus exactly cancelling the yaw tendency regardless of airspeed.

In airplanes which have movable gun gas deflectors to prevent adverse effects on jet engine air intake, it is a further object of the present invention to provide yaw compensating means which also corrects for any yaw tendency caused by the gun gas deflectors when open in operating position.

BRIEF SUMMARY OF THE INVENTION

Briefly, my invention comprises an interconnect between the gun trigger and a directional control member of the aircraft, the interconnect including means adding a signal into the normal actuating means for the rudder member, for example, to deflect the rubber in a compensating direction when the trigger is operated, and means modifying the signal intensity in accordance with measured dynamic air pressure to deflect the rudder the proper amount to exactly cancel the moment of the off-center gun firing operation. An electro-hydraulic surface control system will usually be installed in aircraft where the present invention is applicable. Therefore, the rudder signal provided by this invention is preferably an electrical signal fed to the electro-hydraulic rudder servo actuator. The signal is preferably derived from a reference voltage supply source of known magnitude and then modified by a variable electrical element controlled by a transducer connected to the pressure output of a dynamic air pressure sensor, such as a pitot tube.

When a movable gun gas deflector is used in the aircraft gun firing system to prevent engine flame-out when the gun is fired, the gun trigger normally has two detent positions; at the first detent position, the deflector is opened or swung out into place, and at the second detent position the gun is fired. Assuming the open gas deflector member or door causes a significant yawing moment, the rudder should be deflected a constant amount regardless of airspeed or dynamic air pressure to correct and null the yaw. Therefore, my invention also provides a first, constant, signal to the rudder when the trigger is pressed to the first detent, or first contact position. Then when the second detent or contact position is reached, the interconnect system provides a second signal to the rudder in accordance with dynamic air pressure. The sequencing means for these two signal functions comprises first circuit means (energized at the first trigger contact) connecting the desired constant signal directly to the rudder servo actuator and second circuit means energized at the second trigger detent contact position to also connect the pressure-variable signal to the rudder servo actuator through the aforementioned variable electrical element. The two separately switched signal can originate at a common supply source and when properly conditioned may be merely mixed together at a common summing point at the rudder servo actuator input.

The invention will be more clearly understood by reference to the specification of a preferred mode of carrying out the invention as set forth in the following detailed description, and to the accompanying illustrative drawings.

DETAILED DESCRIPTION

Figure 1:
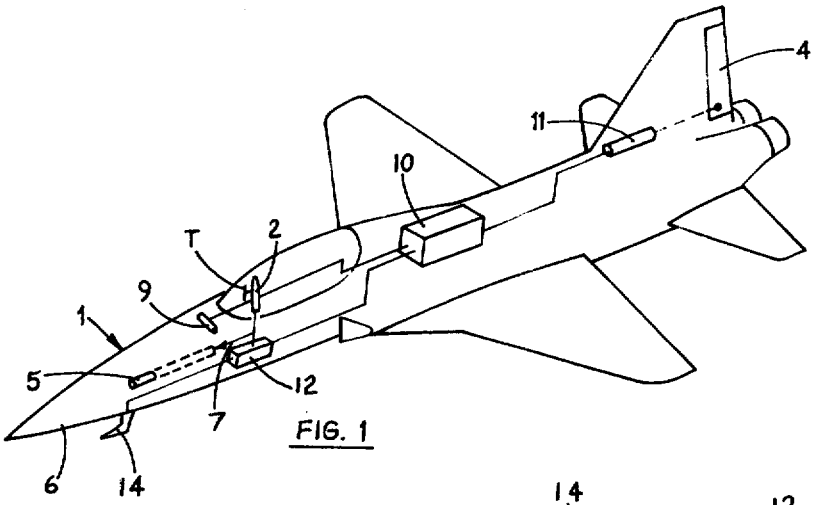
FIG. 1 is a perspective view of an airplane having a single off-center buried in the fuselage, showing in diagrammatic form the elements of the present gun-to-rudder interconnect system.

Referring first to FIG. 1 for a detailed description of specific apparatus embodying the present invention, an airplane 1 has a pilot's control member 2, rudder surface 4 and a forward pointed gun 5 extending out of the left side of the forward portion of the airplane fuselage 6. A gun trigger T is mounted on the front of control member 2, and fires gun 5 by means of a control link 7. One pilot's rudder pedal 9 is also shown, connected to a stability augmenter 10 which operates the valve of a conventional type of hydraulic cylinder actuator 11 drivingly connected to the rudder 4. In this case, the stability augmenter 10 includes the electro-hydraulic servo actuator mentioned previously, and the stability augmenter 10 will be referred to later in more detail.

The gun trigger T also effectively connects to a transducer 12 whose variable input is from the pressure output port of a pitot tube 14. Transducer 12 modifies or regulates an output voltage therefrom in accordance with dynamic compressible air pressure, $Q_c$, which voltage signal is then fed to the stability augmenter 10 in addition to the manual control from the rudder pedal 9.

Figure 2:
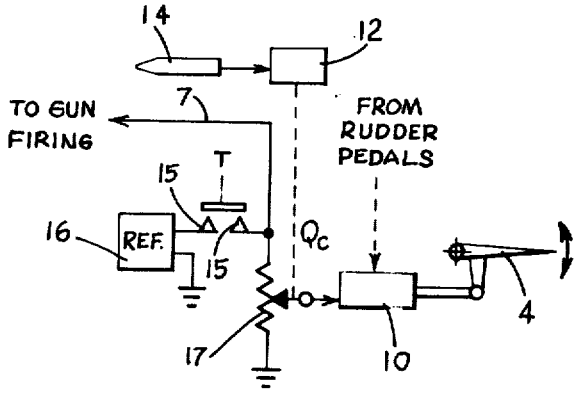
FIG. 2 is a block diagram showing the basic form of this interconnect invention connected to the airplane rudder.

As shown in FIG. 2, the trigger T when actuated closes switch contacts 15 connecting an electrical signal from a reference voltage source 16 to a transducer-operated potentiometer 17. The transducer 12 may be a bellows type well known in the art, to which air is admitted at a pressure corresponding to $Q_c$ and the bellows output movement mechanically controls the potentiometer 17 to produce an output voltage at the potentiometer movable contact proportional to $Q_c$. The hydraulic cylinder actuator 11 of FIG. 1 has been omitted in FIG. 2 for the purpose of showing only the basics of the present invention. The stability augmenter 10 actually includes an electrically controlled fluid-operated augmenter actuator 20 (FIG. 5) acting as a variable-length link in series with a push-pull rod 21 of the mechanically movable pilot's controlled rudder system. Since such augmenters and servo-mechanisms are well known and take various forms in the aircraft field, a detailed description of the present stability augmenter is not necessary. For the present invention, the teaching of a desired electrical signal entering an electromechanical servo-mechanism in the rudder control system is sufficient for instructing persons skilled in this art. For this reason, the block diagram of FIG. 2 represents the main essentials of this invention.

As will be understood, the recoil force of gun firing creates a certain constant yawing moment each time it is fired. But this moment cannot be translated to a constant rudder deflection signal since a given rudder deflection will produce different yawing and turning effects on the airplane at different airspeeds. Thus the voltage from reference source 16 (FIG. 2) is modified by the potentiometer 17 in proportion to dynamic compressible air pressure, $Q_c$, obtained at the pitot tube 14, to then be used as a rudder deflection signal. Those skilled in the art will readily be able to formulate the proper transducer-to-potentiometer coaction needed to fit a given airplane rudder response characteristic. The rudder will usually be moved an amount varying in some inverse proportion to $Q_c$. Also, it is well known in the art how to connect the compensating rudder control signal from the potentiometer 17 in series with the normal manually, or otherwise, controlled rudder movement.

Figure 3:
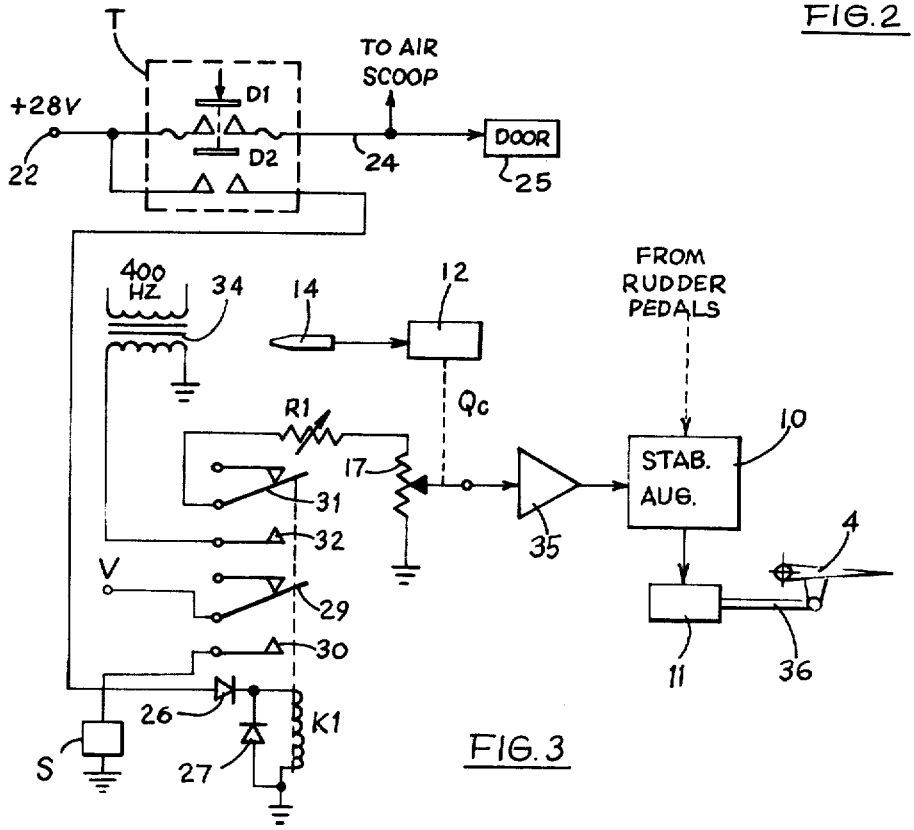
FIG. 3 is a schematic diagram of a simple preferred embodiment of the invention.

FIG. 3 shows the details of a complete system incorporating the basic present invention. A nominal 28 volt dc supply terminal 22 is connected to one contact of each of the first and second pair of detent contacts $D_1$ and $D_2$ of the trigger T. The other contact at trigger position $D_1$ is connected by lead 24 to open a gas deflector door 25 forward of the muzzle of gun 5, and to open gun gas scavenging air scoops (not shown) in the airplane fuselage 6. In this system of FIG. 3, it is assumed that the opening of gas deflector door 25 has negligible yawing effect on the airplane 1. Or, the gas deflector door 25 may be omitted from the airplane as far as FIG. 3 is concerned.

The other trigger contact at position $D_2$ is connected to one end of the actuating coil of a gun firing relay K1 through an isolating diode 26, and the other coil end is grounded. A protective diode 27 is commonly connected across the relay coil.

A first switch pole 29 and a first pole normally open contact 30 of relay K1 are connected to a gun firing circuit, which may comprise a voltage source V and a gun firing solenoid S at the gun, whereby when firing relay K1 is energized, the gun 5 is fired. A second switch pole 31 of relay K1 is connected through a gain adjusting variable resistance R1 to the upper end of the transducer potentiometer 17, the lower end being grounded. A second pole normally open contact 32 of relay K1 is provided with a reference voltage from a reference signal transformer 34, which may be a 400 Hz signal, for example, supplied from any convenient source (not shown) in the airplane. The reference voltage supplied to the second pole normally open contact 32 may be chosen to be two volts, for example only, and this reference voltage should be held constant.

From the output tap of potentiometer 17, the $Q_c$ signal is fed to a first buffer amplifier 35 and from there to an input of the stability augmenter 10. As described before, the $Q_c$ signal is added to the rudder pedal command movements within stability augmenter 10 to drive the rudder actuator 11. An actuator output rod 36 is linked directly to the rudder 4 to operate the latter.

Operation of the device of FIG. 3 is evident. When trigger T is actuated to its first detent position, electrical power is supplied through contacts at $D_1$ to open the air scoop(s) and to swing out or open the gas deflector door 25. At the trigger second detent position, contacts at $D_2$ cause energization of gun firing relay K1 which normally fires the gun by way of the closure of the first pole contacts 29 and 30, energizing firing solenoid S. Actually, there is preferably a safety circuit (not shown) which prevents gun firing until gas deflector door 25 is open. At the same time, closure of second pole contacts 31 and 32 switches in the reference voltage to energize potentiometer 17 and produce the proper $Q_c$ signal which supplies the stability augmenter 10 with the rudder compensation signal. Release of trigger T de-energizes relay K1 and removes the yaw compensation signal.

Figure 4:
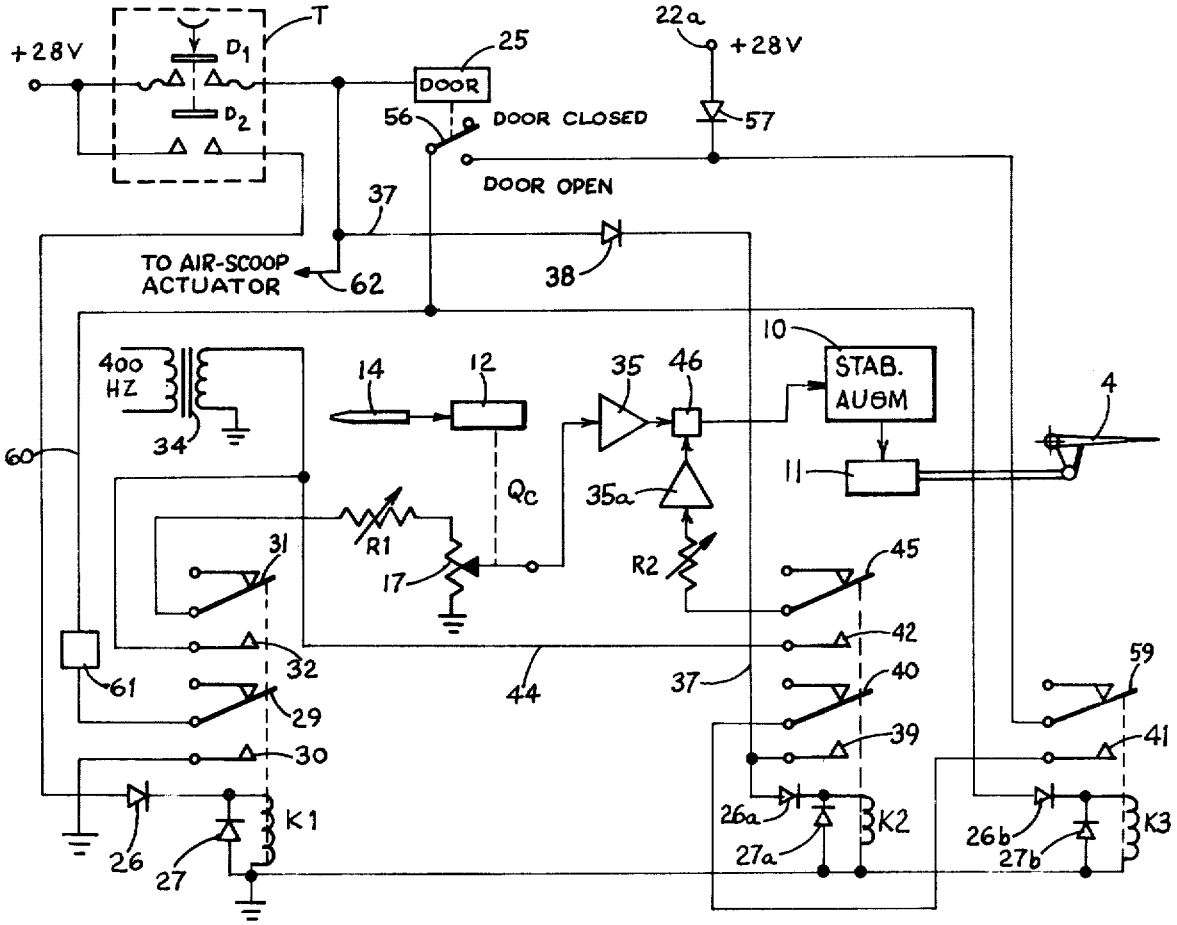
FIG. 4 is a schematic diagram of the present invention having a two-step operation to provide for inclusion of an extendable gun gas deflector door.

In FIG. 4, the detailed schematic of a system of the present invention incorporating rudder correction for the additional yawing that a gun blast deflector door 25 might cause is shown. This assumes that the operation of gas deflector door 25 to the open position from a closed flush position causes a measurable yaw moment which is objectionable. In this case, the yaw moment of such a door will vary in proportion to $Q_c$ the same as a given degree of rudder deflection creates an aerodynamic response to the airplane (yaw) varying in proportion to $Q_c$. Therefore, what is desired is to deflect the rudder a predetermined constant amount (in the yaw cancelling direction) when the deflector door 25 is opened, and then add to this constant amount the same variable amount produced as in FIG. 3 at the time the gun is fired.

As shown in FIG. 4, actuation of trigger T to second detent $D_2$ causes energization of gun firing relay K1 as before. However, at the trigger contacts for first detent $D_1$, additional equipment is brought into operation. Besides completing a circuit to open gas deflector door 25 and the gas purging air scoops (not shown), closure of trigger contacts at $D_1$ energizes a relay wire 37 connected to the anode of a blocking diode 38, the cathode of which is connected to one end of a control relay K2, the other end of K2 being grounded. Additional diodes **26*a* and 27*a*** are used at the relay again. The cathode of diode 38 also connects to a first pole normally open contact 39 of relay K2. A first switch pole 40 of control relay K2 is connected to a normally open contact 41 of a locking relay K3.

The firing relay second pole 31 is connected as in FIG. 3; when actuated, it feeds the reference signal voltage from reference transformer 34 through normally open contact 32 and through variable resistance R1 to the top, ungrounded, end of potentiometer 17.

At control relay K2, a second pole normally open contact 42 is connected by a conductor 44 to the reference transformer 34 in parallel with the firing relay second pole contact 32. A control relay second switch pole 45 is connected through a variable resistance R2 into a second buffer or isolation amplifier 35*a*, the output of which is added to the output of first buffer amplifier 35 in an adder 46 before entering the stability augmenter 10.

Figure 5:
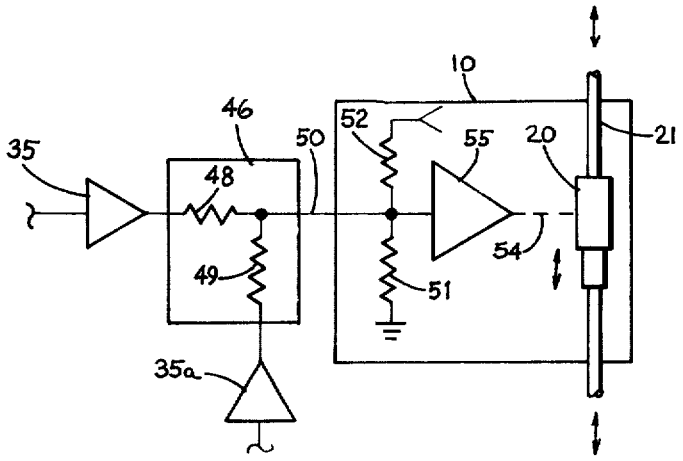
FIG. 5 is a detailed schematic portion of the system of FIG. 4 showing typical input connections to a stability augmenter in the airplane flight surface control system.

FIG. 5 shows in more detail an example of adder 46 and a portion of stability augmenter 10. The voltage signal from first buffer or isolation amplifier 35 is added to the second buffer amplifier 35*a* signal through respective adder resistors 48 and 49 onto a common line 50 across an input resistance 51, the far end of which is grounded. Input resistance 51 may be physically within or outside of augmenter 10, as well as the adder resistors 48 and 49. The common line 50 forms a summing junction carrying a composite signal into the stability augmenter 10 to act on the rudder. Another adding resistance 52 is shown, by which some further signal may be added to the augmenter system. This may be a rudder trim control signal, for example, or other additional rudder input signal which the airplane may provide. Any number of various control signals can be added here, as is common knowledge. A dash line 54 from the output of an augmenter amplifier 55 represents the operating connection to the augmenter actuator 20 which, as mentioned previously, lengthens or shortens the push-pull rod 21 drivingly connected to the rudder 4.

At the gas deflector door 25, a position switch 56 is mechanically actuated by the door to be closed only when the door 25 is open. One side of switch 56 leads (preferably through another isolating diode 57) to a 28 volt supply terminal 22*a*. The other side of position switch 56 leads to one end of locking relay K3, the other end being grounded. Diodes 26*b* and 27*b* are use again. A switch pole 59 of relay K3 leads to the supply terminal 22*a* through diode 57. In the "door open" position of position switch 56, a safety lead 60 is part of the gun firing safety circuit mentioned previously. This safety lead 60 is energized only when deflector door 25 is open, and may be connected to one side of a gun firing solenoid 61 at the gun 5, which, when energized, directly fires the gun. Although the firing solenoid 61 is shown in FIG. 4 as being energized by a 28-volt d.c. circuit, it will be understood that the circuit may be modified to provide whatever voltage is required by the solenoid, d.c. or a.c. The other side of gun solenoid 61 may be connected through the normally open first pole contacts 29 and 30 of gun firing relay K1 to ground. This is one way of preventing gun firing until firing relay K1 is energized and door position switch 56 is closed, i.e., deflector door 25 is completely open. The door opens and locks rapidly under the action of a hydraulic cylinder and piston (not shown).

Operating sequence of the system of FIG. 4 will now be described. When trigger T is squeezed to the first detent position only, power is supplied through contacts at $D_1$ to open the gun as gas deflector door 25 and to open the gun bay scavenging air scoops (not shown) by means of a branch lead 62. Further, via relay wire 37, control relay K2 is energized, and contacts at its second pole 45 close to connect the reference voltage from reference transformer 34 through gainadjusting resistance R2 to the second buffer amplifier 35*a*. The resulting output signal is passed on to the stability augmenter 10 which results in a rudder deflection cancelling out the yaw moment produced by the open deflector door 25. Contacts at the first pole 40 of this relay K2 are also closed when the relay K2 is actuated.

Next, as soon as deflector door 25 has reached its open position, position switch 56 closes to furnish power to energize locking relay K3. As a consequence, relay K3 switch contacts 59, 41 close, thus completing a 28 volt power connection through relay K2 closed first pole contacts 39, 40 and thence through the coil of relay K2 to lock it in energized position until deflector door 25 goes closed, regardless of whether the $D_1$ trigger contacts are released or not. Further, the safety lead 60 to gun firing solenoid 61 is "hot" but the gun will not fire until firing relay K1 is energized to close relay contacts 29 and 30 in the circuit of solenoid 61.

As the trigger T is further pulled to second detent, it contacts at $D_2$ connect 28 volt power to the firing relay K1 and actuate it. This closes both its switch poles 29 and 31. The first pole contacts 29, 30 close and will start firing the gun 5 if the gas deflector door 25 is open to provide power on the safety lead 60 to the gun firing solenoid 61 as described. The closing of firing relay second pole contacts 31, 32 connects the reference voltage from reference transformer 34 through R1 to the top of potentiometer 17 where it is modified into the proper rudder control signal by $Q_c$ transducer 12. This signal, after passing through first buffer amplifier 35, is added to the existing signal from second buffer amplifier 35*a* in adder 46. Then the sum of the two signals is fed to the stability augmenter 10, moving the rudder 4 to its proper desired position compensating for the total yawing moment induced by the open gas deflector door 25 and the recoil of the firing gun 5. Thus, the object of my invention is accomplished.

When the trigger is released all the way, the gun immediately stops firing due to the opening of firing relay K1, and the rudder deflection signal to compensate for gun firing is removed, but the deflector door 25 actually lags and remains open for a short time interval thus keeping control relay K2 and locking relay K3 energized (through closed position switch 56) for the time being and retaining the rudder deflection signal compensating for the open deflector door 25.

Next, as soon as gas deflector door 25 actually closes from its open position, relays K2 and K3 drop out and the rudder deflecting signal through resistance R2 is removed. At this point it can be seen why blocking diode 38 is used. Otherwise, the existing 28 volts at closed relay contacts 39, 40 would always retain power on wire 37 which would keep the door 25 open. However, the diode 38 is polarized to block current flow causing such action, thus letting door 25 close after trigger contacts $D_1$ open. The entire system is now in its original non-operating condition, ready to act again when the gun trigger T is pulled.

Thus it is seen that the present invention solves the problem of yawing produced by the recoil force of off-center gun firing with a simple modification of the existing aircraft components, requiring only a few small additional standard parts. The circuits shown herein can obviously be modified without departing from the essence of this invention. Other specific apparatus may be used as the means for adding together the two rudder compensating command signals shown herein. Further, the gun can obviously be placed at other locations on the airplane, such as on the wing, for example, and can be fixed rear-firing. This same teaching can be applied to an aircraft elevator or elevon control system, if necessary, if the gun recoil acts substantially above or below the aircraft aerodynamic center of gravity. In addition, the invention is not restricted to use with any one type of the general class of aircraft, such as the fixed wing, heavier-than-air airplane 1 shown.

While in order to comply with the statute, the invention has been described in language more or less specific as to structural features, it is to be understood that the invention is not limited to the specific features shown, but that the means and construction herein disclosed comprise the preferred mode of putting the invention into effect, and the invention is therefore claimed in any of its forms or modifications within the legitimate and valid scope of the appended claims.

What is claimed is:

1. In an aircraft with an off-center gun having an off-center recoil producing a directional type moment on said aircraft when fired and a movable pilot-controlled control surface producing aircraft flight deflection about substantially the same axis as said directional moment; means for compensating for said moment comprising:

a. an interconnect system operatively connected between a trigger of said gun and said control surface;

b. said interconnect system having means for deflecting said surface separate from the pilot-controlled surface movement and in a direction to counteract said moment; and c. means for operatively energizing said interconnect system responsive to the pulling of said trigger.

2. Apparatus in accordance with claim 1 wherein said interconnect system comprises means for deflecting said surface an amount in a predetermined relation to dynamic air pressure on said aircraft.

3. Apparatus in accordance with claim 1 wherein said aircraft includes an electrical power supply and wherein said interconnect system comprises:

a. electrical trigger contacts arranged to be closed when said trigger is actuated to fire said gun;

b. a gun firing relay connected in circuit with said power supply to be energized when said trigger contacts are closed;

c. firing means responsive to closure of said trigger contacts for firing said gun;

d. a source of reference voltage in said aircraft;

e. a pair of normally open signal contacts operated by said firing relay;

f. a potentiometer having two ends and a movable tap contact;

g. electrical means connecting said reference voltage source, said signal contacts and said ends of said potentiometer in circuit for energizing said potentiometer from said source when said signal contacts are closed;

h. a sensor of dynamic air pressure acting on said aircraft;

i. a transducer having its input connected to the output of said sensor and its output connected to said potentiometer tap for moving said tap in accordance with said dynamic air pressure to produce a signal at said tap; and j. means electrically connected to said potentiometer tap for deflecting said control surface in accordance with said signal.

4. Apparatus in accordance with claim 1 wherein said aircraft includes an electrohydraulic servo control system for pilot's movement of said control surface, said servo control system having an electrical input, and wherein said interconnect system comprises a source of reference voltage, transducer means for modifying said reference voltage in proportion to $Q_c$, and means connecting said modified voltage to said electrical input of said servo control system.

5. Apparatus in accordance with claim 4 wherein said transducer means comprises a fluid pressure inlet, an electrical potentiometer having a movable contact tap, and means for moving said potentiometer tap in accordance with fluid pressure at said inlet, and including an input connection to said transducer inlet from a source of dynamic air pressure on said aircraft, electrical switching means connected in series circuit with said potentiometer, said switching means having normally open contacts connected to be closed in response to gun trigger actuation, said series circuit connected across said reference voltage, and said potentiometer tap connected to said electrical input of said servo control system.

6. In an aircraft having an off-center gun and a movable gun gas deflector, a gun trigger having a first detent position when actuated for opening said gas deflector and a second detent position for firing the gun, the open position of said gas deflector causing a first directional type moment on said aircraft, and the firing of said gun causing a second directional type moment on said aircraft in substantially the same direction as said first moment, and a movable pilot-controlled control surface producing aircraft flight deflection about substantially the same axis as said first and second moments; means for compensating for said moments comprising:

a. an interconnect system operatively connected between said trigger and said control surface;

b. first control means in said interconnect system for deflecting said surface separate from the pilot-controlled surface movement to counteract said first moment;

c. second control means in said interconnect system for deflecting said surface separate from the pilot-controlled surface movement and in addition to the first control means deflection, to counteract said second moment;

d. first switching means for operatively energizing said first control means responsive to actuation of said trigger to said first detent position; and e. second switching means for operatively energizing said second control means responsive to actuation of said trigger to said second detent position.

7. Apparatus in accordance with claim 6 wherein said first control means comprises means producing a predetermined constant surface deflecting signal to said surface and wherein said second control means comprises means producing a surface deflecting signal to said surface variable in accordance with a predetermined relation to $Q_c$.

8. Apparatus in accordance with claim 6 wherein said aircraft includes an electrical power supply and wherein said interconnect system comprises:

a. a first pair of electrical trigger contacts arranged to be closed when said trigger is actuated to said first detent position, and a second pair of electrical trigger contacts arranged to be closed in addition to said first pair when said trigger is further actuated to said second detent position;

b. a control relay and said gun gas deflector connected in parallel with said power supply to be opened and energized, respectively, when said first pair of trigger contacts is closed;

c. a source of reference voltage in said aircraft;

d. a pair of normally open first signal contacts operated by said control relay;

e. first signal output means;

f. electrical means connecting said reference voltage source, said first signal contacts and said first signal output means in circuit for energizing said first signal output means from said reference source when said first signal contacts are closed, to produce a first signal at said first signal output means;

g. a gun firing relay connected in circuit with said power supply to be energized when said second pair of trigger contacts is closed;

h. gun firing means responsive to closure of said second pair of trigger contacts for firing said gun;

i. a pair of normally open second signal contacts operated by said firing relay;

j. a potentiometer having two ends and a movable tap contact;

k. electrical means connecting said reference voltage source, said second signal contacts and said potentiometer ends in circuit for energizing said potentiometer from said reference source when said second signal contacts are closed;

l. a sensor of dynamic air pressure acting on said aircraft;

m. a transducer having its input connected to the output of said sensor and its output connected to said potentiometer tap for moving said tap in accordance with said dynamic air pressure to produce a second signal at said tap;

n. an adder;

o. electrical means connecting said first signal output means and said potentiometer tap to separate inputs of said adder; and p. means electrically connected to the output of said adder for deflecting said control surface in accordance with the sum of said first and second signals.

9. Apparatus in accordance with claim 8 including:

a. a gas deflector position switch arranged to be closed only when said deflector is open;

b. a locking relay connected in circuit with said power supply and said position switch to be energized only when said position switch is closed; and c. locking relay contacts interconnected between said locking relay and said control relay for locking said control relay energized until said position switch is open.

10. Apparatus in accordance with claim 8 including:

a. a gun gas deflector position switch arranged to be closed only when said deflector is open; and b. electrical safety means connecting said gun firing means, said second pair of trigger contacts and said deflector position switch in circuit with said power supply for firing said gun only when said gas deflector is open.

* * * * *